US007464615B2

(12) United States Patent
Usami et al.

(10) Patent No.: US 7,464,615 B2
(45) Date of Patent: Dec. 16, 2008

(54) STARTER

(75) Inventors: Shinji Usami, Okazaki (JP); Youichi Hasegawa, Kasugai (JP); Tomoya Imanishi, Kariya (JP)

(73) Assignee: Denso Corporation, Kariya (JP)

( * ) Notice: Subject to any disclaimer, the term of this patent is extended or adjusted under 35 U.S.C. 154(b) by 213 days.

(21) Appl. No.: 11/643,972

(22) Filed: Dec. 22, 2006

(65) Prior Publication Data

US 2007/0163381 A1 Jul. 19, 2007

(30) Foreign Application Priority Data

Jan. 17, 2006 (JP) ..... 2006-008832

(51) Int. Cl.
*F02N 15/06* (2006.01)

(52) U.S. Cl. ..... 74/7 C; 74/606 A; 290/48; 310/88

(58) Field of Classification Search ..... 74/6, 74/7 R, 7 C, 7 E, 606 R, 606 A; 290/38 A, 290/48; 310/85, 88, 89
See application file for complete search history.

(56) References Cited

U.S. PATENT DOCUMENTS 4,491,754 A * 1/1985 Gotoh ..... 310/88
4,978,875 A * 12/1990 Okamoto ..... 310/88
4,994,699 A * 2/1991 Shiina ..... 310/88
5,006,742 A * 4/1991 Strobl et al. ..... 310/88
5,010,265 A * 4/1991 Tanaka et al. ..... 310/88
5,053,633 A * 10/1991 Sugiyama et al. ..... 290/48
5,101,114 A * 3/1992 Isozumi et al. ..... 290/48
5,336,954 A * 8/1994 Shiroyama ..... 310/88
5,747,904 A * 5/1998 Sudhoff et al. ..... 310/88
5,929,544 A * 7/1999 Maekawa et al. ..... 310/88
6,371,167 B1 * 4/2002 Hosoya et al. ..... 138/177
2001/0039845 A1 * 11/2001 Tachibana ..... 74/6
2005/0081659 A1 4/2005 Murase et al.
2006/0267433 A1 * 11/2006 Usami et al. ..... 310/89

FOREIGN PATENT DOCUMENTS

JP U 4-137460 12/1992
JP A 2005-120899 5/2005

* cited by examiner

*Primary Examiner*—Richard W Ridley
*Assistant Examiner*—Phillip Johnson
(74) *Attorney, Agent, or Firm*—Oliff & Berridge, PLC

(57) ABSTRACT

The starter includes a housing housing a solenoid and fixed to an engine, a center case held between a motor thereof and the housing, a clutch housed in the center case, and a pinion shaft movable in its axial direction and spline-connected to an inner periphery of an inner tube of the clutch, which is rotatably supported by a bearing. The housing has a tubular wall section through which the pinion shaft extends and to which the center case is coupled in the axial direction. The tubular wall section is formed with a through hole. The center case has a bearing holding section holding the bearing and a cylindrical projecting section projecting in the axial direction towards the housing at a position radially outwardly of the bearing holding section inside the tubular wall section. The outer periphery of the projecting section faces the through hole.

6 Claims, 4 Drawing Sheets

STARTER

CROSS-REFERENCE TO RELATED APPLICATION

This application is related to Japanese Patent Application No. 2006-8832 filed on Jan. 17, 2006, the contents of which are hereby incorporated by reference.

BACKGROUND OF THE INVENTION

1. Field of the Invention

The present invention relates to a starter for starting an engine.

2. Background of the Invention

As disclosed, for example, in Japanese Patent Application Laid-open No. 2005-120899, a common starter mounted on a vehicle for starting a vehicle engine includes a clutch for transmitting a drive torque generated by an electric motor to a pinion shaft movably disposed in its axial direction. The pinion shaft has a pinion gear at a front tip portion thereof, which can mesh with a ring gear of the vehicle engine. The clutch has an inner tube which is rotatably supported by a center case through a ball bearing, and to which the drive torque of the motor is transmitted.

The pinion shaft is spline-connected to an inner periphery of the inner tube at a rear side end portion thereof, and rotatably and slidably supported by a housing through a bearing at a front side end portion thereof. The pinion gear is mounted to the front tip portion of the pinion shaft, which protrudes from the bearing so as to be exposed outside the housing. In such a starter where the pinion gear is exposed outside the housing, the clutch is disposed in an enclosed space formed between the housing and the motor.

Accordingly, the conventional starter described above has a problem in that the ball bearing thereof may heat up and be damaged if an engine starting operation is repeatedly performed under extremely high temperature conditions, because the ball bearing is disposed in the enclosed space. In addition, there is a fear that water enters the starter from a fitting portion between the housing and the center case, and accumulated in the enclosed space if a temperature difference (negative pressure) between inside and outside the starter is large when the starter is flooded with water at the time of washing a car on which the starter is mounted, or when the car is running in the rain.

SUMMARY OF THE INVENTION

The present invention provides a starter for starting an engine comprising:

a motor generating a torque;

a housing having a solenoid and fixed to the engine;

a center case held between a yoke of the motor and the housing;

a clutch housed in the center case and having a clutch outer and an inner tube, the inner tube being rotatably supported by the center case through a bearing, the torque of the motor being transmitted to the inner tube through the clutch outer;

a pinion shaft spline-connected to an inner periphery of the inner tube at one end portion thereof, and supported by the housing at the other end portion thereof so as to be rotatable and movable in an axial direction thereof; and a pinion gear mounted to a tip of the other end portion of the pinion shaft, the pinion gear meshing with a ring gear of the engine when the pinion shaft is moved by an action of the solenoid in a direction opposite to the motor;

the housing having a tubular wall section through which the pinion shaft extends and to which the center case is coupled in the axial direction, the tubular wall section being formed with a through hole penetrating a wall thereof and extending in a direction perpendicular to the axial direction, the center case having a bearing holding section holding the bearing and a cylindrical projecting section projecting in the axial direction towards the housing at a position radially outwardly of the bearing holding section inside the tubular wall section, an outer periphery of the cylindrical projecting section facing the through hole.

According to the present invention, when the starter repeatedly performs the engine starting operation under extremely high temperature conditions, and accordingly the bearing heats up, the heat of the bearing is transmitted from the bearing holding section to the projecting section. And the heat dissipated from the projecting section is discharged to the outside through the drainage hole of the drain member fitted to the through hole. Since the projecting section provided in the center case and serving as a radiating fin is located so as to face the through hole, the heat dissipated from the projecting section is not trapped inside the starter, but discharged to the outside through the drainage hole of the drain member. Hence, even when the starter repeatedly performs the engine starting operation under extremely high temperature conditions, the bearing can be prevented from being damaged, because the temperature of the bearing does not rise excessively.

The center case may be made of steel, or metal having a thermal conductivity higher than that of steel.

The starter may further comprise a drain member fitted into the through hole.

The drain member may have a drainage section situated outside the tubular wall section, the drainage section having a drainage hole extending in a direction perpendicular to the axial direction and opening to the through hole, and a terminating plate partially closing an end of the drainage hole, the terminating plate being provided with at least one wall to define at least one exit of the drainage hole between an outer periphery of the tubular wall section and the terminating plate.

The terminating plate may be circular, and have a diameter larger than a diameter of the through hole, the exit being situated radially inwardly of the terminating plate.

Other advantages and features of the invention will become apparent from the following description including the drawings and claims.

PREFERRED EMBODIMENTS OF THE INVENTION

First Embodiment

Figure 1:
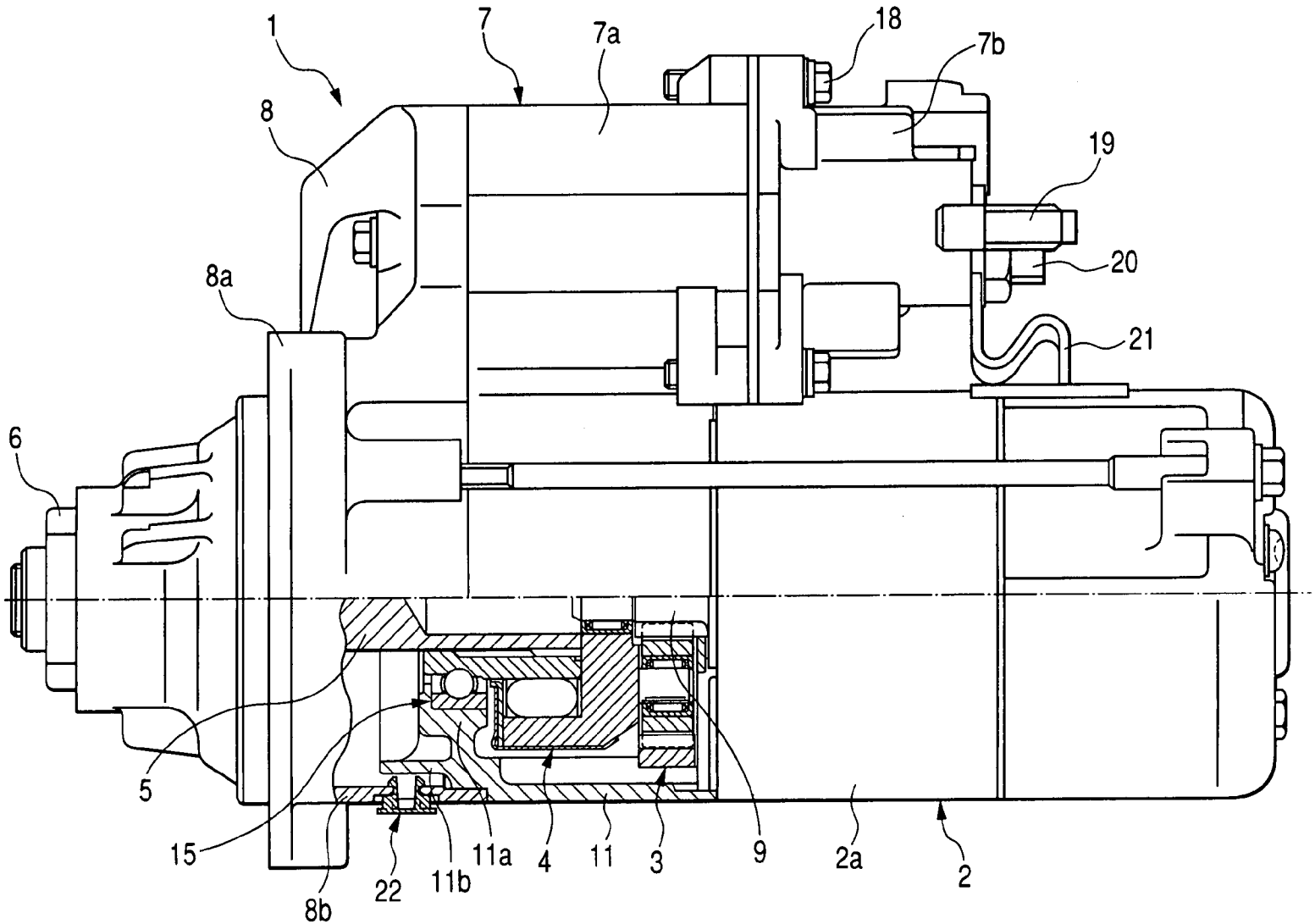
FIG. 1 is a side view including a partial cross-sectional view of a starter according to a first embodiment of the invention.

FIG. 1 is a side view including a partial cross-sectional view of a starter 1 according to a first embodiment of the invention. The starter 1 includes a motor 2 for generating a torque, a speed reduction device 3 for reducing the rotation of the motor 2, a pinion shaft 5 coupled to the speed reduction device 3 through a clutch 4, a pinion gear 6 mounted to a front tip portion of the pinion shaft 5, an electromagnetic switch 7 operating to close and open a main contact (to be described later) provided in a power supply circuit (not shown) of the motor 2 in order to move the pinion shaft 5 in the axial direction by means of a shift lever (not shown), and a housing 8 in which the electromagnetic switch 7 is housed, and to which the motor 2 is fixed.

Figure 2:
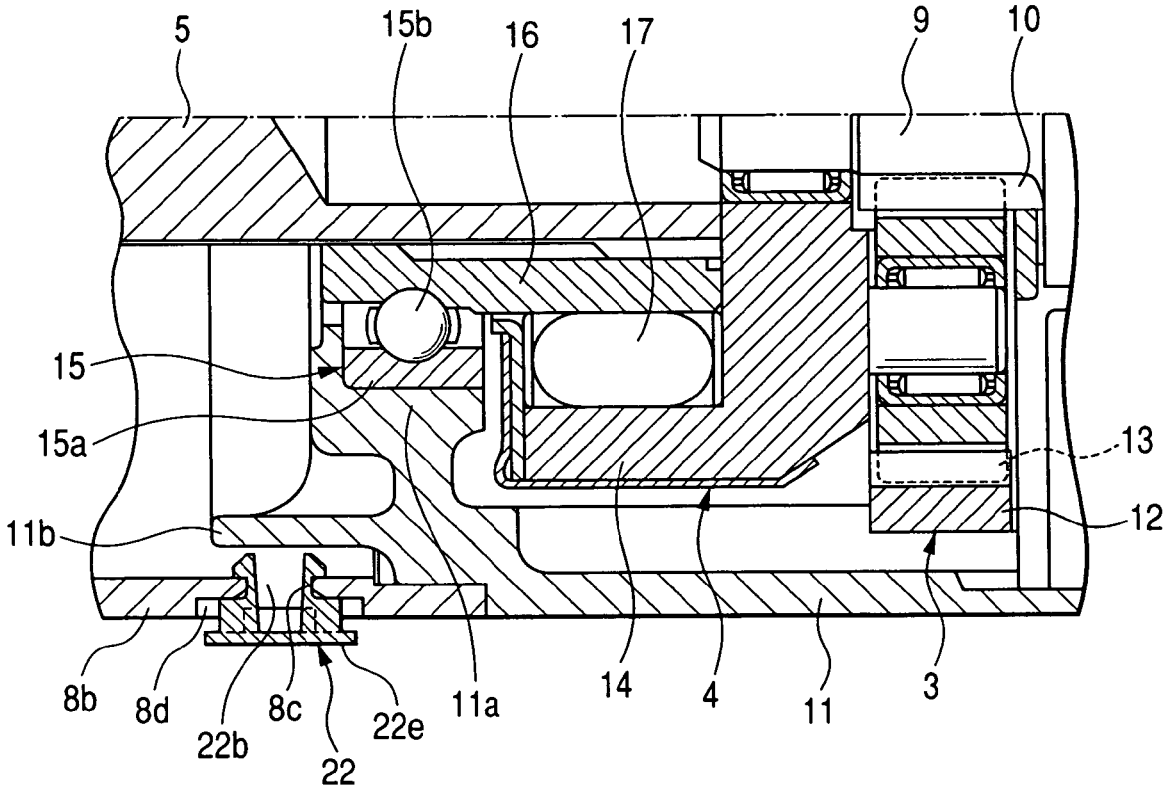
FIG. 2 is a partial cross-sectional view of the starter according to the first embodiment of the invention.

The motor 2 is an electric DC motor producing an electromagnetic force when the main contact is closed by the action of the electromagnetic switch 7 in order to supply electric power from a vehicle battery to the motor 2, to thereby generate a torque at an armature (not shown) of the motor 2. The speed reduction device 3 is a planetary gear device capable of reducing the rotation of the motor 2 on the same axis as the axis of a rotating shaft of the armature (referred to as an armature shaft 9 hereinafter). As shown in FIG. 2, this speed reduction device 3 includes a sun gear 10 mounted to the armature shaft 9, a ring-like internal gear 12 which is coaxial with the sun gear 10 and the rotation of which is restrained by a center case 11, and a plurality of planetary gears 13 meshing with the sun gear 10 and the internal gear 12. The orbital motion of the planetary gears 13 is transmitted to the pinion shaft 5 through the clutch 4.

As shown in FIG. 2, the clutch 4 includes a clutch outer 14 to which the torque of the motor 2 is transmitted through the speed reduction device 3, an inner tube 16 rotatably supported by the center case 11 through a bearing 15, and rollers 17 disposed between the clutch outer 14 and the inner tube 16. The clutch 4 serves as an over-running clutch allowing torque transmission from the clutch outer 14 to the inner tube 16 through the rollers 17, while blocking torque transmission from the inner tube 16 to the clutch outer 14. The bearing 15 is a ball bearing which utilizes the inner tube 16 as an inner ring thereof. A plurality of balls 15*b* are rotatably held between a rolling groove formed in the outer periphery of the inner tube 16 and a rolling groove formed in the inner periphery of an outer ring 15*a*.

The center case 11, which is made of metal having a high thermal conductivity (steel, or aluminum that has a thermal conductivity higher than steel, for example), is held between a yoke 2*a* of the motor 2 and the housing 8 so as to cover the circumferences of the speed reduction device 3 and the clutch 4. The center case 11 has a bearing holding section 11*a* for holding the bearing 15, and a projecting section 11*b* located near the bearing holding section 11*a*. The projecting section 11*b*, which has a cylindrical shape, and the thickness of which is equal to or slightly smaller than a thickness of the center case 1, projects in the axial direction towards the housing 8 side at a position radially outwardly of the bearing holding section 11*a*.

One end portion of the pinion shaft 5 is helical-spline-connected to the inner periphery of the inner tube 16, and the other end portion is rotatably and slidably supported by the housing 8 through a bearing (not shown). The pinion gear 6 is spline-connected to the front tip portion of the pinion shaft 5 projecting in a direction opposite to the clutch 4 (in a leftward direction in FIG. 1). The electromagnetic switch 7 includes a solenoid 7*a* generating a magnetic force to attract a plunger (not shown) when supplied with a current, and a contact cover 7*b* fixed to the solenoid 7*a* by a screw 18. The main contact is housed in the contact cover 7*b*.

The main contact is constituted by two stationary contacts (not shown), and a movable contact configured to move in one with the plunger. When electrical continuity between the two stationary contacts is made through the movable contact, the main contact is closed, and when the continuity between the two stationary contacts is broken, the main contact is opened. The contact cover 7*b* is provided with a B-terminal 19 to which a battery cable (not shown) is connected, and an M-terminal to which a motor side terminal 21 is connected.

The housing 8 has a flange section 8*a* to be fixed to an engine (not shown), and a tubular wall section 8*b* to which the center casing 11 is coupled in the axial direction at a side opposite to the engine. As shown in FIG. 2, the tubular wall section 8*b* is formed with a through hole 8*c* penetrating a wall thereof and extending in a direction perpendicular to the axial direction. The through hole 8*c* is located radially outside the projecting section 11*b* provided in the center case 11, and opens to a bottom side of the tubular wall section 8*b*. A drain member 22 is fitted into the through hole 8*c*. A counter bore 8*d* is formed in a portion of the outer periphery of the tubular wall section 8*b* encircling the through hole 8*c*, so that the drain member 22 can sit on a flat surface.

Figure 3A:
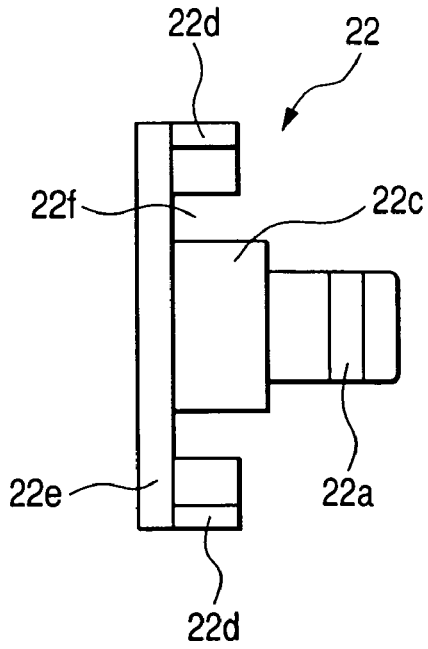
FIGS. 3A, 3B, and 3C are a side view, a plan view, and a cross-sectional view of a drain member of the starter according to the first embodiment of the invention.
Figure 3B:
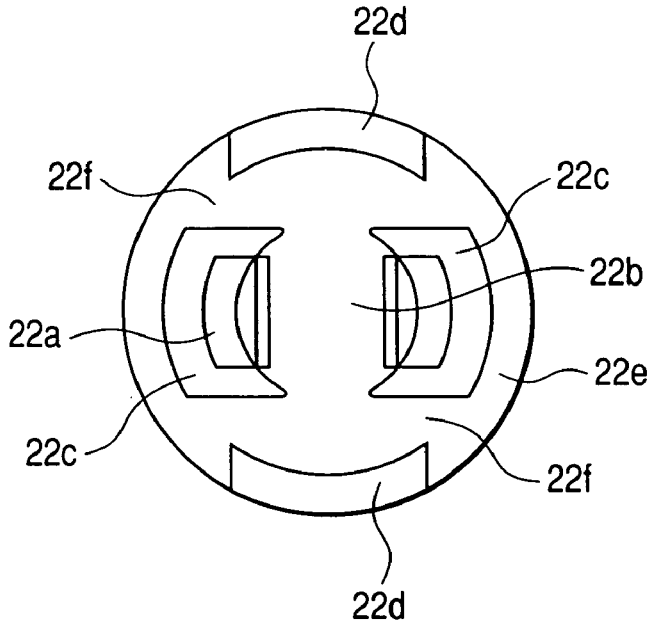

The drain member 22, which may be made of resin, includes a fitting section and a drainage section as explained below with reference to FIGS. 3A to 3C.

Figure 3C:
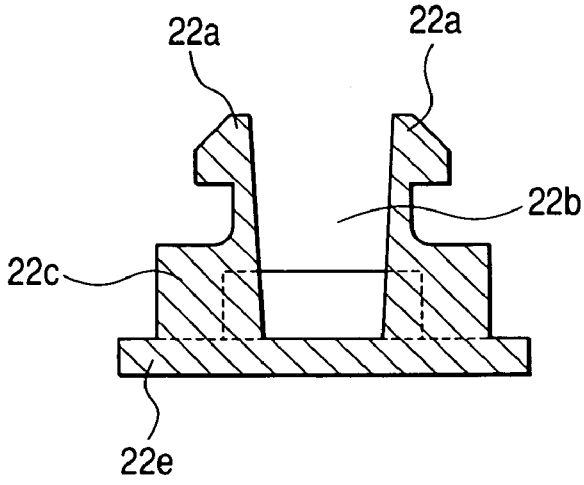

As shown in FIG. 3C, the fitting section has a pair of locking claws 22*a* facing each other with a predetermined distance therebetween. The locking claws 22*a* are inserted inside the tubular wall section 8*b* through the through hole 8*c* to be locked to the inner periphery of the tubular wall section 8*b* (see FIG. 2). The drainage section, which is formed integral with the locking claws 22*a*, has a pair of fixed walls 22*c* defining a drainage hole 22*b* in communication with the through hole 8*c*, a pair of waterproof walls 22*d* situated perpendicular to the fixed walls 22*c*, a circular terminating plate 22*e* partially closing an end of the drainage hole 22*b*, and exits 22*f* of the drainage hole 22*b* formed between the fixed walls 22*c* and the waterproof walls 22*d*. As shown in FIG. 3B, the exits 22*f* of the drainage hole 22*b* are formed radially inwardly of the terminating plate 22*e*.

Next, the operation of the starter 1 is explained. When a starter switch (not shown) is operated, as a result of which the solenoid 7*a* generates a magnetic force by which the plunger is attracted, the movement of the plunger is transmitted to the pinion shaft 5 through the shift lever. In consequence, the pinion shaft 5 moves in a direction opposite to the motor 2 (in the leftward direction in FIG. 1) while rotating around the inner tube 16 by the action of the helical spline, and stops when the pinion gear 6 abuts against a ring gear (not shown) of the engine.

After that, when the plunger further moves to close the main contact, the motor 2 is supplied with electric power from the battery, as a result of which the motor 2 generates a torque at the armature. A resultant rotation of the armature is reduced by the speed reduction device 3 and transmitted to the pinion shaft 5 through the clutch 4. Since this causes the pinion shaft 5 to rotate, when the pinion gear 6 comes to a position where it can mesh with the ring gear, the pinion gear 6 is moved frontward by the action of a repulsive force accumulated in a drive spring (not shown), and as a result the pinion gear 6 is meshed with the ring gear. As a consequence, the torque of the motor 2 amplified by the speed reduction device 3 is transmitted from the pinion gear 6 to the ring gear, to thereby crank the engine.

When the starter switch is turned off, and accordingly the attraction force of the solenoid 7*a* disappears after the engine has been started up, the plunger is pushed back by a repulsive force of a return spring (not shown) to open the main contact. As a result, the supply of electric power from the battery to the motor 2 is interrupted, and the rotation of the armature therefore decreases gradually. Also, when the plunger is pushed back, since the shift lever swings in a direction opposite to the direction in which it swings at the time of starting the engine, the pinion gear 6 disengages from the ring gear, and the pinion shaft 5 moves backward to a certain position (to the stationary position shown in FIG. 1).

The above described first embodiment of the invention offers the following advantages.

When the starter 1 repeatedly performs the engine starting operation under extremely high temperature conditions, and accordingly the bearing 15 heats up, the heat of the bearing 15 is transmitted from the bearing holding section 11*a* to the projecting section 11*b*. And the heat dissipated from the projecting section 11*b* is discharged to the outside through the drainage hole 22*b* of the drain member 22 fitted to the through hole 8*c*. Since the projecting section 11*b* provided in the center case 11 and serving as a radiating fin is located so as to face the through hole 8*c*, the heat dissipated from the projecting section 11*b* is not trapped inside the starter 1, but discharged to the outside through the drainage hole 22 of the drain member 22. Hence, even when the starter 1 repeatedly performs the engine starting operation under extremely high temperature conditions, the bearing 15 can be prevented from being damaged, because the temperature of the bearing 15 does not rise excessively.

Furthermore, since the center case 11 is made of metal having a high thermal conductivity (aluminum or steel, for example), the projecting section 11*b* provided in the center case 11 and serving as a radiating fin for cooling the bearing 15 can have a high cooling performance. In addition, the drain member 22 fitted to the through hole 8*c* makes it possible to discharge, through the through hole 8*c*, the water that has entered the starter 1, while preventing water from entering the starter 1 through the through hole 8*c*.

It should be noted that since the end of the drainage hole 22*b* facing the through hole 8*c* is closed by the terminating plate 22*e*, and the exits 22*f* are located radially inwardly of the terminating plate 22*e*, water is hard to enter the starter 1. For example, when water splashes over the tubular wall section 8*b* from radially outside (from downside in FIG. 2), since the water hits against the terminating plate 22*e*, it is hard for the water to enter the starter 1.

Second Embodiment

Figure 4:
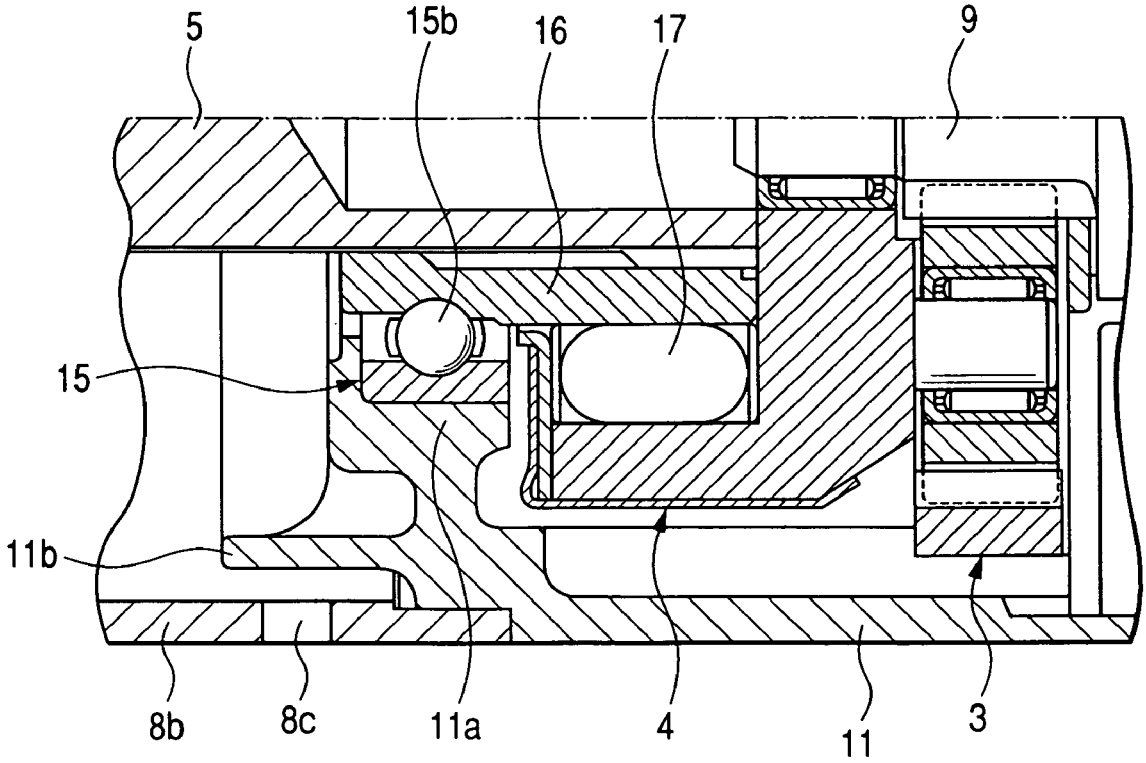
FIG. 4 is a partial cross-sectional view of a starter according to a second embodiment of the invention.

FIG. 4 is a partial cross-sectional view of a starter 1 according to a second embodiment of the invention. The second embodiment is characterized in that the drain member 22 is eliminated. In the second embodiment, although the tubular wall section 8*b* of the housing 8 is formed with the through hole 8*c* at a position facing the projecting section 11*b* provided in the center case 11, the drain member 22 is not fitted to the through hole 8*c*. Also according to the second embodiment, since the heat of the bearing 15 is transmitted from the bearing holding section 11*a* to the projecting section 11*b*, and the heat dissipated from the projecting section 11*b* is discharged to the outside through the through hole 8*c*, even when the starter 1 repeatedly performs the engine starting operation under extremely high temperature conditions, the bearing 15 can be prevented from being damaged, because the temperature of the bearing 15 does not rise excessively. Furthermore, since the center case 11 is made of metal having a high thermal conductivity (aluminum or steel, for example), the projecting section 11*b* provided in the center case 11 and serving as a radiating fin for cooling the bearing 15 can have a high cooling performance.

Furthermore, the through hole 8*c* formed in the tubular wall section 8*b* so as to open to a bottom side of the tubular wall section 8*b* (to the downside in FIG. 4) can be used as a drain hole when the starter is mounted to the engine. That is, the water that has entered the starter 1 from a fitting portion between the housing 8 and the center case 11 can be discharged from the through hole 8*c*. In addition, since the projecting section 11*b* closely facing the through hole 8*c* serves as a water proof wall, it becomes possible to prevent water from entering the starter 1 when the starter 1 is flooded with water at the time of washing a car on which the starter is mounted, or when the car is running in the rain.

The above explained preferred embodiments are exemplary of the invention of the present application which is described solely by the claims appended below. It should be understood that modifications of the preferred embodiments may be made as would occur to one of skill in the art.

What is claimed is:

1. A starter for starting an engine comprising:

a motor generating a torque;

a housing having a solenoid and fixed to said engine;

a center case held between a yoke of said motor and said housing;

a clutch housed in said center case and having a clutch outer and an inner tube, said inner tube being rotatably supported by said center case through a bearing, said torque of said motor being transmitted to said inner tube through said clutch outer;

a pinion shaft spline-connected to an inner periphery of said inner tube at one end portion thereof, and supported by said housing at the other end portion thereof so as to be rotatable and movable in an axial direction thereof; and a pinion gear mounted to a tip of said other end portion of said pinion shaft, said pinion gear meshing with a ring gear of said engine when said pinion shaft is moved by an action of said solenoid in a direction opposite to said motor;

said housing having a tubular wall section through which said pinion shaft extends and to which said center case is coupled in said axial direction, said tubular wall section being formed with a through hole penetrating a wall thereof and extending in a direction perpendicular to said axial direction, said center case having a bearing holding section holding said bearing and a cylindrical projecting section projecting in said axial direction towards said housing at a position radially outwardly of said bearing holding section inside said tubular wall section, an outer periphery of said cylindrical projecting section facing said through hole.

2. The starter according to claim 1, wherein said center case is made of steel.

3. The starter according to claim 1, wherein said center case is made of metal having a thermal conductivity higher than a thermal conductivity of steel.

4. The starter according to claim 1, further comprising a drain member fitted into said through hole.

5. The starter according to claim 4, wherein said drain member has a drainage section situated outside said tubular wall section, said drainage section having a drainage hole extending in a direction perpendicular to said axial direction and opening to said through hole, and a terminating plate partially closing an end of said drainage hole, said terminating plate being provided with at least one wall to define at least one exit of said drainage hole between an outer periphery of said tubular wall section and said terminating plate.

6. The starter according to claim 5, wherein said terminating plate is circular, and has a diameter larger than a diameter of said through hole, said exit being situated radially inwardly of said terminating plate.

* * * * *